US010934504B2

(12) United States Patent
Cropper et al.

(10) Patent No.: US 10,934,504 B2
(45) **Date of Patent: *Mar. 2, 2021**

(54) LAUNDRY TREATMENT COMPOSITIONS COMPRISING PERFUME AND SILICA MICROPARTICLES

(71) Applicant: Conopco, Inc., Englewood Cliffs, NJ (US)

(72) Inventors: Martin Peter Cropper, Birkenhead (GB); Craig Warren Jones, Wirral (GB); Hailey Kelso, Chester (GB); James Merrington, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/345,761

(22) PCT Filed: Oct. 17, 2017

(86) PCT No.: PCT/EP2017/076498

§ 371 (c)(1),
(2) Date: Apr. 29, 2019

(87) PCT Pub. No.: WO2018/082915

PCT Pub. Date: May 11, 2018

(65) Prior Publication Data

US 2020/0056125 A1 Feb. 20, 2020

(30) Foreign Application Priority Data

Nov. 3, 2016 (EP) ..... 16197098

(51) Int. Cl.
*C11D 3/50* (2006.01)
*C11D 1/94* (2006.01)
(Continued)

(52) U.S. Cl.
CPC ..... *C11D 3/505* (2013.01); *C11D 1/94* (2013.01); *C11D 3/30* (2013.01); *C11D 3/3734* (2013.01);
(Continued)

(58) Field of Classification Search
CPC ..... C11D 11/0017; C11D 1/62; C11D 1/94; C11D 3/124; C11D 3/505; C11D 11/0088;
(Continued)

(56) References Cited

U.S. PATENT DOCUMENTS 6,245,732 B1 6/2001 Gallon
8,367,793 B2 2/2013 Edmiston
(Continued)

FOREIGN PATENT DOCUMENTS

EP 0535942 9/1992
EP 0535942 4/1993
(Continued)

OTHER PUBLICATIONS

Sousa; Encapsulation of essential oils in SiO2 microcapsules and release behaviour of volatile compounds; Journal of Microencpsulation; 2014; pp. 627-635; vol. 31(7).
(Continued)

*Primary Examiner* — John R Hardee
(74) *Attorney, Agent, or Firm* — Greenberg Traurig, LLP

(57) ABSTRACT

A laundry treatment composition comprising: i) at least 5 wt % amphiphilic material, preferably selected from the group consisting of detersive surfactants and quaternary ammonium compounds, ii) from 0.1 to 5 wt % perfume, iii) 0.2 to 6 wt % of porous microparticles comprising sol-gel derived material, the sol-gel derived material including a plurality of alkylsiloxy substituents and wherein the sol-gel derived material is obtained from: (a) at least one first alkoxysilane precursor having the formula: $(R'O)_3$—Si—$(CH_2)_n$—Ar—$(CH_2)_m$—Si—$(OR')_3$ (1) where n and m are individually an integer from 1 to 8, Ar is a single-, fused-, or poly-aromatic ring, and each R' is independently a $C_1$ to $C_5$ alkyl group and (b) optionally, at least one second precursor having the formula: (formula) (2) where x is 1, 2, 3 or 4; y is 0, 1, 2, 3; z is 0, 1; the total of x+y+z is 4; each R is independently an organic functional group; each an R' is independently a $C_1$ to $C_5$ alkyl group and R" is an organic bridging group, where the sol-gel derived material is swellable to at least 2.5 times its dry mass, when placed in excess acetone, whereby the weight amount of iii) exceeds the weight amount of ii) in the composition. Also, a method of prolongation of perfume delivery from a liquid laundry treatment composition comprising perfume, the method comprising the steps of: (i) adding sol-gel derived silica microparticles as described above to the liquid composition; C30068 EP (C) CPL (ii) optionally, diluting the liquid and applying the liquid or the diluted liquid to a surface to be treated to deposit the microparticles onto the surface; (iii) rinsing away the liquid or diluted liquid to leave perfume loaded microparticles on the surface to be treated; and (iv) releasing perfume from the microparticles over period of about 24 hours.

$$(R'O)_3—Si—(CH_2)_n—Ar—(CH_2)_m—Si—(OR')_3 \quad (1)$$

$$_x(R'O)—\overset{(R)_y}{\overset{|}{Si}}—\left(\overset{(R)_y}{\overset{|}{(R'')—Si}}—(OR')_x\right)_z \quad (2)$$

13 Claims, No Drawings

(51) Int. Cl.

| | |
|---|---|
| ***C11D 3/30*** | (2006.01) |
| ***C11D 3/37*** | (2006.01) |
| ***C11D 11/00*** | (2006.01) |
| ***C11D 17/00*** | (2006.01) |

(52) U.S. Cl.
CPC ..... *C11D 11/0017* (2013.01); *C11D 17/0013* (2013.01)

(58) Field of Classification Search
CPC ..... C11D 1/90; C11D 17/0013; C11D 3/50; C04B 24/42; B01D 2311/12; B01D 2253/25
See application file for complete search history.

(56) References Cited

U.S. PATENT DOCUMENTS

| | | | | |
|---|---|---|---|---|
| 9,440,869 | B2 | 9/2016 | Edmiston et al. | |
| 10,046,291 | B2 | 8/2018 | Yamazaki | |
| 2006/0074006 | A1 | 4/2006 | Rubin | |
| 2006/0160711 | A1 | 7/2006 | Frank | |
| 2007/0112242 | A1 | 5/2007 | Edmiston | |
| 2008/0199523 | A1 | 8/2008 | Finnie et al. | |
| 2009/0087396 | A1 | 4/2009 | Hwang et al. | |
| 2010/0096334 | A1 | 4/2010 | Edmiston | |
| 2010/0143422 | A1 | 6/2010 | POpplewell et al. | |
| 2011/0195037 | A1 | 8/2011 | Berthier et al. | |
| 2012/0237578 | A1 | 9/2012 | Lei et al. | |
| 2013/0171216 | A1 | 7/2013 | Alden-Danforth et al. | |
| 2015/0083836 | A1 | 3/2015 | Jensen et al. | |
| 2015/0267143 | A1 | 9/2015 | Denutte | |
| 2016/0324746 | A1* | 11/2016 | Edmiston | A61K 8/042 |
| 2018/0002636 | A1* | 1/2018 | Sy | C11D 17/041 |

FOREIGN PATENT DOCUMENTS

| | | | | |
|---|---|---|---|---|
| WO | WO2011085224 | | 7/2011 | |
| WO | WO2011085235 | | 7/2011 | |
| WO | WO2011100532 | | 8/2011 | |
| WO | WO2012088758 | | 7/2012 | |
| WO | WO2014162311 | | 10/2014 | |
| WO | WO2015083836 | | 6/2015 | |
| WO | WO-2015084984 | A2 * | 6/2015 | C08G 77/52 |

OTHER PUBLICATIONS

Ashraf, et al.; Effectiveness of silica based sol-gelmicroencapsulation method for odorants and flavors leading to sustainable environment; Frontiers in Chemistry; 2015; pp. 1-15; vol. 3, article 42.
Ciriminna, et al.; Sol-gel microencapsulation of odorants and flavors: opening the route to sustainable fragrances and aromas; The Royal Society of Chemistry; 2013; pp. 9243-9250; vol. 42.
Cao, et al.; Synthesis of fragrance/silica nanocapsules through a sol-gel; Colloid Poly Sci; 2015; pp. 1129-1139; 293.
Edmiston; Cosmetics & Toiletries; Swellable, Nanoporous Organosilica for Extended and Triggered Release; 2013; pp. 1-6; .
Search Report and Written Opinion in PCTEP2017076498; Jan. 16, 2018.
Search Report and Written Opinion in EP16197098; Feb. 28, 2017.
Search Report & Written Opinion in EP16197115; May 30, 2017.
ABSMaterials Offers Cosmetic-grade Osorb Absorbent Material for Personal Products; Cosmetics.specialchem.com; 2014; pp. 1-2; XP002769036; retrieved from http://cosmetics.specialchem.com/news/prolduct-news/absmaterials-offers-cosmeticgrade-osorb-absorbent-material-for-personal-care-products.
Search Report and Written Opinion in PCTEP2017076497; Dec. 14, 2017.
Vieth, Susanne R; Pratsinis, Sotiris E; Perren Matthias; Journal of Food and Agriculture and Food Chemistry; Aroma Retention in Sol-Gel-Made Silica Particles; 2004; 8; 2004, 52 (19), 5964-5971.
Swellable, Nanoporous Organosilica for Extended Trigger Release; Swellable, Nanoporous Organosilica for extended trigger release; Swellable, Nanoporous Organosilica for extended trigger release; Oct. 10, 2013; 6; 128.
Colleen M. Burkett et al.; Organic-Inorganic Hybrid Materials that Rapidly Swell in; Organic-Inorganic Hybrid Materials that Rapidly Swell in; 2008; 10; 20(4) 1312-1321.

* cited by examiner

LAUNDRY TREATMENT COMPOSITIONS COMPRISING PERFUME AND SILICA MICROPARTICLES

TECHNICAL FIELD

This invention relates to laundry treatment compositions comprising perfume and silica microparticles.

BACKGROUND

Perfume containing microcapsules are used in laundry treatment compositions. To give delayed release of a burst of perfume the microcapsule can have a friable shell that ruptures and releases perfume after the microcapsule has been deposited and dried out. Often free oil perfume is also present in the composition to provide fragrance prior to rupture of the shell and possibly to provide a complimentary fragrance. Neither free oil perfume nor the commonly used friable shell microcapsules sufficiently satisfies the need for delivery of fragrance between the time that clothes are taken from the wash and when they are fully dry some 24 hours later. A need exists for a solution to the problem of fulfilling this so called "Early Freshness Moments", or EFM, perfume delivery.

Inorganic perfume carriers have relatively low perfume loading compared to friable organic polymer shell microcapsules and so are not preferred nowadays for laundry treatment compositions. Furthermore known inorganic perfume carrying materials, such as silica and zeolite, absorb both polar and non-polar materials and also mainly release their perfume into the wash and so do not provide an effective solution to the EFM problem. They also suffer from early release or leakage of their perfume into liquids, where they are not storage stable.

Recently, a new type of organic inorganic hybrid sol gel microparticle has been found and is disclosed in U.S. Pat. No. 8,367,793B2 and US 2010/0096334A1 (ABS Materials), and P. Edmiston, Organic-Inorganic Hybrids, Chem. Mater. 2008, 20, 1312-1321.

Other silica sol gel materials have been disclosed for absorption of perfume but they do not swell as much and do not have the same selectivity for non-polar materials. See for example: WO 2015083836A1, and WO 2012088758A1.

Aroma Retention in Sol-Gel-Made Silica Particles by Veith, Susanne R.; Pratsinis, Sotiris E.; Perren, Matthias; Journal of Agricultural and Food Chemistry (2004), 52(19), 5964-5971. The retention performance of aroma molecules from different chemical classes (e.g., alcohols, esters, aldehydes, and terpenes) by silica particles made by hydrolysis of tetra-Et orthosilicate is investigated. Since particle morphology, porosity, and pore size distribution can be controlled by the sol-gel preparation method, the influence of the nano confinement in the microporous matrix on aroma retention is studied as well as the effect of the initial aroma load of the particles. As the porosity is decreased, aroma molecules are entrapped more efficiently in the silica particles.

More recently in Cosmetics and Toiletries vol 128 No. 10 Oct. 2013 "Swellable, Nanoporous Organosilica for extended and triggered release; Paul L Edmiston investigates the use of nanoporous organosilica (Osorb from ABS materials) for extended release of volatile fragrances and the stimulated release of active ingredients. These materials swell rapidly when immersed in solvents such as ethanol. The animated organosilica consisted of polycondensed alkoxysilane precursors that contain a bridging organic group possessing an aryl ring. This aromatic group allows for pi-pi stacking, enabling the molecular self-assembly of the particles that cross link and thus comprise the matrix. The material may be ground to a powder. The organosilica was prepared using hexamethyldisilazane as post polymerisation derivatisation agent as described in C M Burkett, LA Underwood RS Volzer JA Baughman and PL Edmiston; organic inorganic hybrid materials that rapidly swell in non-polar liquids; nanoscale morphology and swelling mechanism. *Chemistry of Materials* 20(4) 1312-1321 (2008).

Rose extract was diluted 1:20 in dichloromethane and added until the organosilica was fully swollen (5.5 mL/g). The dichloromethane was allowed to evaporate.

None of these prior art documents describes or suggests to use organosilica particles to deliver early freshness moments from laundry treatment compositions comprising perfume.

SUMMARY OF THE INVENTION

According to a first aspect of the present invention there is provided a laundry treatment composition comprising:

i) at least 5 wt % amphiphilic material, preferably selected from the group consisting of detersive surfactants and quaternary ammonium compounds, ii) from 0.1 to 5 wt % perfume, iii) 0.2 to 6 wt % of porous microparticles comprising sol-gel derived material, the sol-gel derived material including a plurality of alkylsiloxy substituents and wherein the sol-gel derived material is obtained from:

(a) at least one first alkoxysilane precursor having the formula:

$$(R'O)_3—Si—(CH_2)_n—Ar—(CH_2)_m—Si—(OR')_3 \quad (1)$$

where n and m are individually an integer from 1 to 8, Ar is a single-, fused-, or poly-aromatic ring, and each R' is independently a $C_1$ to $C_5$ alkyl group and (b) optionally, at least one second precursor having the formula:

$$_x(R'O)—\underset{}{\overset{(R)_y}{\overset{|}{Si}}}—\left(\underset{}{\overset{(R)_y}{\overset{|}{Si}}}—(R'')—Si—(OR')_x\right)_z \quad (2)$$

where x is 1, 2, 3 or 4; y is 0, 1, 2, 3; z is 0, 1; the total of x+y+z is 4; each R is independently an organic functional group; each an R' is independently a $C_1$ to $C_5$ alkyl group and R" is an organic bridging group, where the sol-gel derived material is swellable to at least 2.5 times its dry mass, when placed in excess acetone, whereby the weight amount of iii) exceeds the weight amount of ii) in the composition.

In one embodiment the plurality of alkylsiloxy groups have the formula:

$$—(O)_w—Si—(R_3)_{4-w} \quad (3)$$

where each $R_3$ is independently an organic functional group and w is an integer from 1 to 3.

Preferably at least 70 wt % of the perfume in the composition has a log $K_{ow}$ of greater than 2.8, and more preferably at least 15 wt % has a log $K_{ow}$ greater than 4.

The first alkoxysilane precursors of formula (1) are preferably selected from the group consisting of bis(trimethoxysilylethyl)benzene, 1,4-bis(trimethoxysilylmethyl)benzene and mixtures thereof.

Preferably the microparticles have a volume average swollen diameter of 2 to 100 microns, more preferably 10 to 80 microns.

The microparticles advantageously have a microporous structure.

The amphiphilic material advantageously comprises detersive surfactant for cleaning fabrics. Preferably the detersive surfactant comprises at least 5 wt % anionic surfactant. More preferably the detersive surfactant further comprises at least 2 wt % nonionic surfactant.

Preferred compositions are liquids. Most preferably they are aqueous liquids comprising at least 30 wt % water.

According to a second aspect of the present invention there is provided a method of prolongation of perfume delivery from a liquid laundry treatment composition comprising perfume, the method comprising the steps of:

(i) adding sol-gel derived silica microparticles according to the first aspect to the liquid composition;

(ii) optionally, diluting the liquid and applying the liquid or the diluted liquid to a surface to be treated to deposit the microparticles onto the surface;

(iii) rinsing away the liquid or diluted liquid to leave perfume loaded microparticles on the surface to be treated; and (iv) releasing perfume from the microparticles over period of about 24 hours.

Preferably the weight amount of microparticles added in the method exceeds the weight amount of perfume in the laundry treatment composition.

We have shown that it when used at a surprisingly high ratio with perfume it gives controlled release of perfume that can provide the necessary release of perfume between the time that wet laundry is removed from the wash up to 24 hours to solve the early freshness moment problem.

We have also found that by simply adding the media to a premade liquid laundry treatment composition containing free oil perfume the media affects the subsequent release of perfume to provide the required early freshness moment release profile.

DETAILED DESCRIPTION OF THE INVENTION

Throughout this specification references to percentages are to weight percentages unless the context demands otherwise.

A new type of organically linked silica sol gel microparticle having either a micro- or meso-porous structure has recently been developed as discussed in the background section herein. These hybrid organic-inorganic materials comprise at least one type of organic bridging group that contains an aromatic segment that is flexibly linked to the alkoxysilane polymerisable ends. They differ from other silicas in that they have been described to be reversibly and potentially highly swellable by non-polar materials. We have shown that when added to a detergent liquid at a surprisingly high ratio with perfume it gives a controlled release of perfume that can provide the necessary release of perfume between the time that wet laundry is removed from the wash up to 24 hours to solve the early freshness moment problem.

We have also found that by simply adding the porous sol gel derived microparticles to a premade liquid laundry treatment composition containing free oil perfume the media affects the subsequent release of perfume to provide the required early freshness moment release profile.

Without wishing to be bound by theory it seems that when used at the inventive levels, in surfactant and perfume containing compositions, the sol-gel derived microparticles can absorb a proportion of the total fragrance into the microparticle's 3-D network structure. Subsequently, because the absorption process is reversible, the fragrance is able to diffuse slowly from the particles to provide a reservoir to extend fragrance longevity from a surface to which a composition comprising the fragranced particles has been delivered. This effect does not need any external mechanism to be applied such as solvent pulsing as used previously to flush an active material back out of the microparticle after it has been absorbed Typical synthetic methods for the sol-gel derived microparticles can be found in Chem. Mater. 2008, 20, 1312-1321; and U.S. Pat. No. 8,367,793 B2.

Suitable silica sol gel derived microparticles are available as porous sol gel materials from by ABS Materials Inc., Wooster, Ohio under the tradenames of Osorb™ or SilaFresh™. Osorb media has a microporous morphology in the dry state whereas SilaFresh™ media has a mesoporous structure. Neither product adsorbs water. The sol-gels can further be derivatised with non-ionic deposition aids that are grafted by covalently bonding to the surface of the sol-gel using adaptations of methods previously disclosed and known to the skilled worker. The inclusion of deposition aids is particularly advantageous for delivery from laundry detergents and other perfumed products useful for treating laundry.

The sol-gel derived microparticle composition can be similar or identical to the swellable materials described in US2007/0112242 A1. For example, the sol-gel composition can include a plurality of flexibly tethered and interconnected organosilica particles having diameters on the nanometer scale. The plurality of interconnected organosilica particles can form a disorganized microporous array or matrix defined by a plurality of cross-linked aromatic siloxanes. The organosilica particles can have a multilayer configuration comprising a hydrophilic inner layer and a hydrophobic, aromatic-rich outer layer.

The sol-gel composition has the capability to swell to at least twice its dried volume when placed in contact with a fabric treatment liquid. Without being bound by theory, it is believed that swelling may be derived from the morphology of interconnected organosilica particles that are crosslinked during the gel state to yield a nanoporous material or polymeric matrix. Upon drying the gel and following a derivatization step, tensile forces may be generated by capillary-induced collapse of the polymeric matrix. Stored energy can be released as the matrix relaxes to an expanded state when elements of the fabric treatment compositions disrupt the inter-particle interactions holding the dried material in the collapsed state. New surface area and void volume may then be created, which serves to further capture additional liquid that can diffuse into the expanded pore structure. Initial adsorption to the surface of the composition occurs in the non-swollen state. Further adsorption may then trigger matrix expansion which leads to absorption across the composition-water boundary. Pore filling may lead to further percolation into the composition, followed by continued composition expansion to increase available void volume.

The porous sol-gel composition is obtained from at least one first alkoxysilane precursor having the formula:

$$(RO)_3—Si—(CH_2)_n—Ar—(CH_2)_m—Si—(OR)_3 \quad (1)$$

where n and m are individually an integer from 1 to 8, Ar is a single-, fused-, or poly-aromatic ring, such as a phenyl or naphthyl ring, and each R is independently a $C_1$ to $C_5$ alkyl, such as methyl or ethyl.

Exemplary first alkoxysilane precursors include, without limitation, bis(trialkoxysilylalkyl)benzenes, such as 1,4-bis(trimethoxysilylmethyl)benzene (BTB), bis(triethoxysilylethyl)benzene (BTEB), and mixtures thereof, with bis(triethoxysilylethyl)benzene being preferred.

In another aspect, the porous sol-gel composition is obtained from a mixture of the at least one first alkoxysilane precursor and at least one second alkoxysilane precursor, where the at least one second alkoxysilane precursor has the formula:

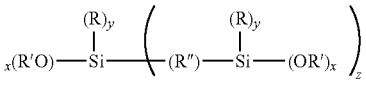

(2)

where x is 1, 2, 3 or 4; y is 0, 1, 2, 3; z is 0, 1; where the total of x+y+z is 4; R is independently an organic functional group; R' is independently an alkyl group; and R" is an organic bridging group, for example an alkyl or aromatic bridging group.

In one aspect, x is 2 or 3, y is 1 or 2 and z is 0 and R' is a methyl, an ethyl, or a propyl group. In another aspect, R comprises an unsubstituted or substituted straight-chain hydrocarbon group, branched-chain hydrocarbon group, cyclic hydrocarbon group, or aromatic hydrocarbon group.

In some embodiments, each R is independently an aliphatic or non-aliphatic hydrocarbon containing up to about 30 carbons, with or without one or more hetero atoms (e.g., sulfur, oxygen, nitrogen, phosphorous, and halogen atoms) or hetero atom-containing moieties. Representative R's include straight-chain hydrocarbons, branched-chain hydrocarbons, cyclic hydrocarbons, and aromatic hydrocarbons and are unsubstituted or substituted. In some aspects, R includes alkyl hydrocarbons, such as $C_1$-$C_3$ alkyls, and aromatic hydrocarbons, such as phenyl, and aromatic hydrocarbons substituted with heteroatom containing moieties, such —OH, —SH, —$NH_2$, and aromatic amines, such as pyridine.

Representative substituents for R include primary amines, such as aminopropyl, secondary amines, such as bis(triethoxysilylpropyl)amine, tertiary amines, thiols, such as mercaptopropyl, isocyanates, such as isocyanopropyl, carbamates, such as propylbenzylcarbamate, alcohols, alkenes, pyridine, halogens, halogenated hydrocarbons or combinations thereof.

Exemplary second alkoxysilane precursors include, without limitation, tetramethoxysilane, methyltrimethoxysilane, methyltriethoxysilane, dimethyldimethoxysilane, dimethyldiethoxysilane, phenyltrimethoxysiliane, aminopropyltrimethoxysilane, (4-ethylbenzyl)trimethoxysilane, 1,6-bis(trimethoxysilyl)hexane, 1,4-bis(triethoxysilyl)benzene, bis(triethoxysilylpropyl)amine, 3-cyanopropyltrimethoxysilane, 3-sulfoxypropyltrimethoxysilane, isocyanopropyltrimethoxysilane, 2-(3,4-epoxycyclohexyl)ethyltrimethoxysilane, and Examples of suitable second precursors include, without limitation, dimethyldimethoxysilane, (4-ethylbenzyl)trimethoxysilane, 1,6-bis(trimethoxysilyl)hexane, 1,4-bis(trimethoxysilyl)benzene, tetramethoxysilane, methyltrimethoxysilane, methyltriethoxysilane, phenyltrimethoxysilane, with dimethyldimethoxysilane, (4-ethylbenzyl)trimethoxysilane, and phenyltrimethoxysilane being preferred.

Other examples of useful second precursors include, without limitation, para-trifluoromethylterafluorophenyltrimethoxysilane, (tridecafluoro-1,1,2,2-tetrahydro-octyl)trimethoxysilane; second precursors having a ligand containing —OH, —SH, —NH2 or aromatic nitrogen groups, such as 2-(trimethoxysilylethyl)pyridine, 3-aminopropyltrimethoxysilane, 3-mercaptopropyltrimethoxysilane, and second precursors with protected amine groups, such as trimethoxypropylbenzylcarbamate.

In one aspect, the second alkoxysilane alkoxysilane precursor is dimethyldimethoxysilane, dimethyldiethoxysilane, phenyltrimethoxysilane or aminopropyltriethoxysilane.

The properties of the sol-gel derived composition can be modified by the second precursor. The second alkoxysilane precursor can be selected to produce sol-gel compositions having improved properties. In one aspect, the sol-gel derived compositions are substantially mesoporous. In one aspect, the sol-gel derived compositions contain less than about 20% micropores and, in one aspect, the sol-gel derived compositions contain less than about 10% micropores. In one aspect, the mesopores have a pore volume greater than 0.50 mL/g as measured by the BET/BJH method and in one aspect, the mesopores have a pore volume greater than 0.75 mL/gas measured by the BET/BJH method. In another aspect, the sol-gel derived composition generates a force upon swelling that is greater than about 200 N/g as measured by swelling with acetone in a confined system; in one aspect, the sol-gel derived composition generates a force upon swelling that is greater than about 400 N/g as measured by swelling with acetone in a confined system and in one aspect one aspect, the sol-gel derived composition generates a force upon swelling that is greater than about 700 N/g as measured by swelling with acetone in a confined system.

The sol-gel derived compositions may absorb at least 2.5 times the volume of acetone per mass of dry sol-gel derived composition. Examples of second precursors useful to effect the swellability of the sol-gel derived composition include dimethyldimethoxysilane, (4-ethylbenzyl)trimethoxysilane, 1,6-bis(trimethoxysilyl)hexane, 1,4-bis(trimethoxysilyl)benzene methyltrimethoxysilane, phenyltrimethoxysilane, with dimethyldimethoxysilane, (4-ethylbenzyl)trimethoxysilane, and phenyltrimethoxysilane being preferred.

The porous sol-gel compositions are obtained from an alkoxysilane precursor reaction medium, under acid or base sol-gel conditions, preferably base sol-gel conditions. In one aspect of the present invention, the alkoxysilane precursor reaction medium contains from about 100:00 vol:vol to about 10:90 vol:vol of the at least one first alkoxysilane precursor to the at least one second alkoxysilane precursor, in one aspect, and from about 20:80 vol:vol to about 50:50 vol:vol first alkoxysilane precursor to second alkoxysilane precursor. In one aspect, the alkoxysilane precursor reaction medium contains 100% of the at least one first alkoxysilane alkoxysilane precursor. The relative amounts of the at least one first alkoxysilane and the at least one second alkoxysilane alkoxysilane precursors in the reaction medium will depend on the particular alkoxysilane precursors and the particular application for the resulting sol-gel composition.

The reaction medium includes a solvent for the alkoxysilane precursors. In some aspects, the solvent has a Dimoth-Reichart solvatochromism parameter ($E_T$) between 170 to 205 kJ/mol. Suitable solvents include, without limitation, tetrahydrofuran (THF), acetone, dichloromethane/THF mixtures containing at least 15% by vol. THF, and THF/acetonitrile mixtures containing at least 50% by vol. THF.

Of these exemplary solvents, THF is preferred. The alkoxysilane precursors are preferably present in the reaction medium at between about 0.25M and about 1M, more preferably between about 0.4M and about 0.8M, most preferably about 0.5 M.

A catalytic solution comprising a catalyst and water is rapidly added to the reaction medium to catalyze the hydrolysis and condensation of the alkoxysilane precursors, so that a sol gel coating is formed on the particles. Conditions for sol-gel reactions are well-known in the art and include the use of acid or base catalysts. Preferred conditions are those that use a base catalyst. Exemplary base catalysts include, without limitation, tetrabutyl ammonium fluoride (TBAF), fluoride salts, including but not limited to potassium fluoride, 1,5-diazabicyclo[4.3.0]non-5-ene (DBN), and alkylamines, including but not limited to propyl amines, of which TBAF is preferred.

As noted above, acid catalysts can be used to form sol-gel coatings, although acid catalysts are less preferred. Exemplary acid catalysts include, without limitation, any strong acid such as hydrochloric acid, phosphoric acid, sulfuric acid and the like.

In one aspect, water is present in the reaction medium at an amount so there is at least one half mole of water per mole of alkoxysilane groups in the alkoxysilane precursors. In one aspect, temperatures at polymerization can range from between the freezing point of the reaction medium up to the boiling point of the reaction medium. And in one aspect, the temperature range is from about 4° C. to about 50° C.

After gellation, the sol-gel coating is preferably aged for an amount of time suitable to induce syneresis, which is the shrinkage of the gel that accompanies solvent evaporation. The aging drives off much, but not necessarily all, of the solvent. While aging times vary depending upon the catalyst and solvent used to form the gel, aging is typically carried out for about 15 minutes up to about 10 days. In one aspect, aging is carried out for at least about 1 hour and, in one aspect, aging is carried out for about 2 to about 10 days. In one aspect, aging temperatures can range from between the freezing point of the solvent or solvent mixture up to the boiling point of the solvent or solvent mixture. And in one aspect, the aging temperature is from about 4° C. to about 50° C. And in some aspects, aging is carried out either in open atmosphere, under reduced pressure, in a container or oven.

After gellation and aging have been completed, the sol-gel composition is rinsed using an acidic solution, with solutions comprising stronger acids being more effective. In one aspect, the rinsing agent comprises concentrations between 0.009 to 0.2% w/v acid in an organic solvent. Representative organic solvents include solvents for the alkoxysilane precursors, including solvents having a Dimoth-Reichart solvatochromism parameter (ET) between 170 to 205 kJ/mol. Suitable solvents for use with the base catalysts include, without limitation, tetrahydrofuran (THF), acetone, dichloromethane/THF mixtures containing at least 15% by vol. THF, and THF/acetonitrile mixtures containing at least 50% by vol. THF. Preferred rinse reagents, include without limitation, 0.01% wt:vol HCl or 0.01% wt:vol H2SO4 in acetone. In one aspect, the sol-gel composition is rinsed with the acidic solution for at least 5 min. And in one aspect, the sol-gel composition is rinsed for a period of time from about 0.5 hr to about 12 hr.

An alternative rinsing method is to use a pseudo-solvent system, such as supercritical carbon dioxide.

After rinsing, the sol-gel derived material is characterized by the presence of residual silanols. In one aspect, the silanol groups are derivatized with a reagent in an amount sufficient to stoichiometrially react with the residual silanols and prevent cross-linking that might otherwise occur between the residual silanol groups. Suitable derivatization reagents include, without limitation, reagents that have both one or more silanol-reactive groups and one or more non-reactive alkyl groups. The derivatization process results in the end-capping of the silanol-terminated polymers present within the sol-gel derived material with alkylsiloxy groups having the formula:

$$—(O)_w—Si—(R_3)_{4-w} \quad (3)$$

where each $R_3$ is independently an organic functional group as described above and w is an integer from 1 to 3.

One suitable class of derivatization reagents includes halosilanes, such as monohalosilane, dihalosilane and trihalosilane derivatization reagents that contain at least one halogen group and at least one alkyl group $R_3$, as described above. The halogen group can be any halogen, preferably Cl, Fl, I, or Br. Representative halosilanederivatization reagents include, without limitation, chlorosilanes, dichlorosilanes, fluorosilanes, difluorosilanes, bromosilanes, dibromosilanes, iodosilanes, and di-iodosilanes. Exemplary halosilanes suitable for use as derivatization reagents include, without limitation, cynanopropyldimethyl-chlorosilane, phenyldimethylchlorosilane, chloromethyldimethylchlorosilane, (trideca-fluoro-1,1,2,2-tertahydro-octyl)dimethylchlorosilane, n-octyldimethylchlorosilane, and n-octadecyldimethylchlorosilane. And in one aspect, the halosilane derivatization reagent is trimethyl chlorosilane.

Another suitable class of derivatization reagents includes silazanes or disilazanes. Any silazane with at least one reactive group and at least one alkyl group $R_3$, as described above can be used. A preferred disilazane is hexamethyldisilazane.

The sol-gel derived composition is preferably rinsed in any of the rinsing agents described above to remove excess derivatization reagent, and then dried. Drying can be carried out under any suitable conditions, but preferably in an oven, e.g., for about 2 hours at about 60° C. to produce the porous, swellable, sol-gel derived composition.

In some aspects, the compositions contain a plurality of flexibly tethered and interconnected organosiloxane particles having diameters on the nanometer scale. The organosiloxane particles form a porous matrix defined by a plurality of aromatically cross-linked organosiloxanes that create a porous structure.

In some aspects, the resulting sol-gel compositions are hydrophobic, resistant to absorbing water, and absorb at least, 2.5 times, even at least five times and sometimes as much as at least ten times the volume of acetone per mass of dry sol-gel derived composition. Without being bound by theory, it is believed that swelling is derived from the morphology of interconnected organosilica particles that are cross-linked during the gel state to yield a porous material or polymeric matrix. Upon drying the gel, tensile forces are generated by capillary-induced collapse of the polymeric matrix. This stored energy can be released as the matrix relaxes to an expanded state when a sorbate disrupts the inter-particle interactions holding the dried material in the collapsed state.

In one aspect, the resulting sol-gel composition contains a plurality of flexibly tethered and interconnected organosiloxane particles having diameters on the nanometer scale. The organosiloxane particles form a porous matrix defined by a plurality of aromatically cross-linked organosiloxanes that create a porous structure. In some aspects, the resulting sol-gel composition has a pore volume of from about 0.9 mL/g to about 1.1 mL/g and, in some aspects, a pore volume of from about 0.2 mL/g to about 0.6 mL/g. In some aspects, the resulting sol-gel composition has a surface area of from about 50 $m^2/g$ to about 600 $m^2/g$ and, in some aspects, a surface area of from about 600 $m^2/g$ to about 1000 $m^2/g$.

In one aspect, the resulting sol-gel composition is hydrophobic, resistant to absorbing water, and swellable to at least 2.5 times its dry mass, when placed in excess acetone, in one aspect, the sol-gel composition is swellable to at least five times its dry mass, when placed in excess acetone and, in one aspect, the sol-gel composition is swellable to at least ten times its dry mass, when placed in excess acetone.

Laundry Treatment Compositions

The laundry treatment composition is not limited as to type. It can be a solid or a liquid. When the process of adding the silica sol gel microparticles to the composition comprising perfume is utilised the composition is a liquid. In order to provide cleaning effect a laundry detergent comprises at least 5 wt % of detersive surfactant. Alternatively in order to provide fabric softening a fabric conditioner comprises at least 5 wt % quaternary ammonium compound. Both are amphiphilic materials. There are few, if any, limitations on the other ingredients in the laundry treatment compositions.

Preferred detersive surfactants are selected from anionic, nonionic, zwitterionic and amphoteric surfactants:

Surfactants assist in removing soil from the textile materials and also assist in maintaining removed soil in solution or suspension in the wash liquor. Anionic or blends of anionic and nonionic surfactants are a preferred feature of the compositions. The amount of anionic surfactant is at least 5 wt %. Preferably, the anionic surfactant forms the majority of the non-soap surfactant.

Anionic

Preferred anionic surfactants are alkyl sulphonates, especially alkylbenzene sulphonates, particularly linear alkylbenzene sulphonates having an alkyl chain length of $C_8$-$C_{15}$. The counter ion for anionic surfactants is generally an alkali metal, typically sodium, although other counter-ions for example MEA, TEA or ammonium can be used.

Suitable linear alkyl benzene sulphonate surfactants include Detal LAS with an alkyl chain length of from 8 to 15, more preferably 12 to 14.

The composition may also comprise an alkyl polyethoxylate sulphate anionic surfactant of the formula (4):

$$RO(C_2H_4O)_xSO_3^-M^+ \quad (4)$$

where R is an alkyl chain having from 10 to 22 carbon atoms, saturated or unsaturated, M is a cation which makes the compound water-soluble, especially an alkali metal, ammonium or substituted ammonium cation, and x averages from 1 to 15.

Preferably R is an alkyl chain having from 12 to 16 carbon atoms, M is Sodium and x averages from 1 to 3, preferably x is 3; This is the anionic surfactant sodium lauryl ether sulphate (SLES). It is the sodium salt of lauryl ether sulphonic acid in which the predominantly C12 lauryl alkyl group has been ethoxylated with an average of 3 moles of ethylene oxide per mole.

Nonionic

Nonionic surfactants include primary and secondary alcohol ethoxylates, especially $C_8$-$C_{20}$ aliphatic alcohol ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used. When included therein the composition contains from 0.2 wt % to 40 wt %, preferably 1 wt % to 20 wt %, more preferably 5 to 15 wt % of a non-ionic surfactant, for example alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

Nonionic surfactants that may be used include the primary and secondary alcohol ethoxylates, especially the $C_8$-$C_{20}$ aliphatic alcohols ethoxylated with an average of from 1 to 35 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

Amine Oxide

The composition may comprise up to 10 wt % of an amine oxide of the formula:

$$R^1N(O)(CH_2R^2)_2$$

In which $R^1$ is a long chain moiety each $CH_2R^2$ are short chain moieties. $R^2$ is preferably selected from hydrogen, methyl and —$CH_2OH$. In general $R^1$ is a primary or branched hydrocarbyl moiety which can be saturated or unsaturated, preferably, $R^1$ is a primary alkyl moiety. $R^1$ is a hydrocarbyl moiety having chain length of from about 8 to about 18.

Preferred amine oxides have $R^1$ is $C_8$-$C_{18}$ alkyl, and $R^2$ is H. These amine oxides are illustrated by $C_{12-14}$ alkyldimethyl amine oxide, hexadecyl dimethylamine oxide, octadecylamine oxide.

A preferred amine oxide material is Lauryl dimethylamine oxide, also known as dodecyldimethylamine oxide or DDAO. Such an amine oxide material is commercially available from Huntsman under the trade name Empigen® OB.

Amine oxides suitable for use herein are also available from Akzo Chemie and Ethyl Corp. See McCutcheon's compilation and Kirk-Othmer review article for alternate amine oxide manufacturers. Whereas in certain of the preferred embodiments $R^2$ is H, it is possible to have $R^2$ slightly larger than H. Specifically, $R^2$ may be $CH_2OH$, for example: hexadecylbis(2-hydroxyethyl)amine oxide, tallowbis(2-hydroxyethyl)amine oxide, stearylbis(2-hydroxyethyl)amine oxide and oleylbis(2-hydroxyethyl)amine oxide.

Preferred amine oxides have the formula:

$$O^-—N^+(Me)_2R^1 \quad (5)$$

where $R^1$ is $C_{12-16}$ alkyl, preferably $C_{12-14}$ alkyl; Me is a methyl group.

Zwitterionic

Nonionic-free systems with up to 95% wt LAS can be made provided that some zwitterionic surfactant, for example carbobetaine, is present. A preferred zwitterionic material is a carbobetaine available from Huntsman under the name Empigen® BB. Betaines and/or amine oxides, improve particulate soil detergency in the compositions.

Other surfactants than LAS, SLES, nonionic and amine oxide/carbobetaine) may be added to the mixture of detersive surfactants. However cationic surfactants are preferably substantially absent.

Although less preferred, some alkyl sulphate surfactant (PAS) may be used, especially the non-ethoxylated $C_{12-15}$ primary and secondary alkyl sulphates. A particularly preferred material, commercially available from BASF, is Sulfopon 1214G.

The preferred quaternary ammonium compounds for use in compositions of the present invention are the so called "ester quats".

Particularly preferred materials are the ester-linked triethanolamine (TEA) quaternary ammonium compounds comprising a mixture of mono-, di- and tri-ester linked components.

Typically, TEA-based fabric softening compounds comprise a mixture of mono, di- and tri-ester forms of the compound where the di-ester linked component comprises no more than 70 wt % of the fabric softening compound, preferably no more than 60 wt % of the fabric softening compound and at least 10 wt % of the monoester linked component.

A first group of quaternary ammonium compounds (QACs) suitable for use in the present invention is represented by formula (6):

$$R1-N^{+}(-[(CH_2)n(TR)]m)-[(CH_2)n(OH)]_3-mX- \quad (6)$$

wherein each R is independently selected from a C5-35 alkyl or alkenyl group; R1 represents a C1-4 alkyl, C2-4 alkenyl or a C1-4 hydroxyalkyl group; T may be either O—CO. (i.e. an ester group bound to R via its carbon atom), or may alternatively be CO—O (i.e. an ester group bound to R via its oxygen atom); n is a number selected from 1 to 4; m is a number selected from 1, 2, or 3; and X— is an anionic counter-ion, such as a halide or alkyl sulphate, e.g. chloride or methylsulfate. Di-esters variants of formula I (i.e. m=2) are preferred and typically have mono- and tri-ester analogues associated with them. Such materials are particularly suitable for use in the present invention.

Suitable actives include soft quaternary ammonium actives such as Stepantex VK90, Stepantex VT90, Stepantex KF90 SP88-2 (ex-Stepan), Prapagen TQN (ex-Clariant), Dehyquart AU-57 (ex-Cognis), Rewoquat WE18 (ex-Degussa) and Tetranyl L1/90N, Tetranyl L190 SP and Tetranyl L190 S (all ex-Kao).

Also suitable are actives rich in the di-esters of triethanolammonium methylsulfate, otherwise referred to as "TEA ester quats".

Commercial examples include Stepantex™ UL85, ex Stepan, Prapagen™ TQL, ex Clariant, and Tetranyl™ AHT-1, ex Kao, (both di-[hardened tallow ester] of triethanolammonium methylsulfate), AT-1 (di-[tallow ester] of triethanolammonium methylsulfate), and L5/90 (di-[palm ester] of triethanolammonium methylsulfate), both ex Kao, and Rewoquat™ WE15 (a di-ester of triethanolammonium methylsulfate having fatty acyl residues deriving from C10-C20 and C16-C18 unsaturated fatty acids), ex Witco Corporation.

A second group of QACs suitable for use in the invention is represented by formula (7):

$$(R1)_3N^{+}-(CH_2)n-CH(-CH_2TR_2)-TR2X- \quad (7)$$

wherein each R1 group is independently selected from C1-4 alkyl, hydroxyalkyl or C2-4 alkenyl groups; and wherein each R2 group is independently selected from C8-28 alkyl or alkenyl groups; and wherein n, T, and X— are as defined above.

Preferred materials of this second group include 1,2 bis[tallowoyloxy]-3-trimethylammonium propane chloride, 1,2 bis[hardened tallowoyloxy]-3-trimethylammonium propane chloride, 1,2-bis[oleoyloxy]-3-trimethylammonium propane chloride, and 1,2 bis[stearoyloxy]-3-trimethylammonium propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (8):

$$(R1)_2\text{-}N^{+}-[(CH_2)n\text{-}T\text{-}R2]_2X- \quad (8)$$

wherein each R1 group is independently selected from C1-4 alkyl, or C2-4 alkenyl groups; and wherein each R2 group is independently selected from C8-28 alkyl or alkenyl groups; and n, T, and X— are as defined above. Preferred materials of this third group include bis(2-tallowoyloxyethyl)dimethyl ammonium chloride, partially hardened and hardened versions thereof.

The iodine value of the quaternary ammonium fabric conditioning material is preferably from 0 to 80, more preferably from 0 to 60, and most preferably from 0 to 45. The iodine value may be chosen as appropriate. Essentially saturated material having an iodine value of from 0 to 5, preferably from 0 to 1 may be used in the compositions of the invention. Such materials are known as "hardened" quaternary ammonium compounds.

A further preferred range of iodine values is from 20 to 60, preferably 25 to 50, more preferably from 30 to 45. A material of this type is a "soft" triethanolamine quaternary ammonium compound, preferably triethanolamine di-alkylester methylsulfate. Such ester-linked triethanolamine quaternary ammonium compounds comprise unsaturated fatty chains.

Iodine value as used in the context of the present invention refers to, the fatty acid used to produce the QAC, the measurement of the degree of unsaturation present in a material by a method of nmr spectroscopy as described in Anal. Chem., 34, 1136 (1962) Johnson and Shoolery.

A further type of softening compound may be a non-ester quaternary ammonium material represented by formula (9):

$$R^1-N^{+}(R^1)(R^2)-R^2 \quad X^- \quad (9)$$

wherein each R1 group is independently selected from C1-4 alkyl, hydroxyalkyl or C2-4 alkenyl groups; R2 group is independently selected from C8-28 alkyl or alkenyl groups, and X— is as defined above.

Particularly for laundry detergents, polymers may be added to the composition to assist with soil suspension, cleaning and soil release. A particularly preferred class of polymer for use in the composition is polyethylene imine, preferably modified polyethylene imine. Polyethylene imines are materials composed of ethylene imine units —CH2CH2NH— and, where branched, the hydrogen on the nitrogen is replaced by another chain of ethylene imine units. These polyethyleneimines can be prepared, for example, by polymerizing ethyleneimine in the presence of a catalyst for example carbon dioxide, sodium bisulphite, sulphuric acid, hydrogen peroxide, hydrochloric acid, acetic acid, and the like. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951.

The compositions may include 0.5 wt % or more of a soil release polymer which is substantive to polyester fabric. Such polymers typically have a fabric substantive midblock formed from propylene terephthalate repeat units and one or two end blocks of capped polyalkylene oxide, typically PEG 750 to 2000 with methyl end capping.

In addition to a soil release polymer there may be used dye transfer inhibition polymers, anti redeposition polymers and cotton soil release polymers, especially those based on modified cellulosic materials.

The composition may further include hydrotropes, one or more enzymes selected from protease, lipase, amylase, mannanase, cellulase, peroxidase/oxidase, pectate lyase. Enzyme stabilizers may also be present.

When a lipase enzyme is included a lignin compound may be used in the composition in an amount that can be optimized by trial and error.

It may be advantageous to include fluorescer in the compositions. Compositions may comprise a weight efficient bleach system.

Perfume

As already discussed the log partition coefficient of a significant part of the free oil perfume mix used is preferably high. Encapsulated perfumes may be utilized in addition to the free oil perfume that interacts with the sol gel particles. Any such additional encapsulated perfume may advantageously be provided with a deposition aid to increase the efficiency of perfume deposition and retention on fabrics. The deposition aid is preferably attached to the encapsulate by means of a covalent bond, entanglement or strong adsorption, preferably by a covalent bond or entanglement.

Further Optional Ingredients:

The compositions may contain one or more other ingredients. Such ingredients include viscosity modifiers, foam boosting agents, preservatives (e.g. bactericides), pH buffering agents, polyelectrolytes, anti-shrinking agents, anti-wrinkle agents, anti-oxidants, sunscreens, anti-corrosion agents, drape imparting agents, anti-static agents and ironing aids. The compositions may further comprise colorants, pearlisers and/or opacifiers, and shading dye.

The compositions may also optionally contain relatively low levels of organic detergent builder or sequestrant material. Examples include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, and citric acid. Other examples are DEQUEST™, organic phosphonate type sequestering agents sold by Thermphos and alkanehydroxy phosphonates.

Other suitable organic builders include the higher molecular weight polymers and copolymers known to have builder properties. For example, such materials include appropriate polyacrylic acid, polymaleic acid, and polyacrylic/polymaleic acid copolymers and their salts, for example those sold by BASF under the name SOKALAN™.

If utilized, the organic builder materials may comprise from about 0.5% to 20 wt %, preferably from 1 wt % to 10 wt %, of the composition. The preferred builder level is less than 10 wt % and preferably less than 5 wt % of the composition. A preferred sequestrant is HEDP (1-Hydroxyethylidene-1,1,-diphosphonic acid), for example sold as Dequest 2010. Also suitable but less preferred as it gives inferior cleaning results is Dequest® 2066 (Diethylenetriamine penta(methylene phosphonic acid or Heptasodium DTPMP).

The presence of some buffer is preferred for pH control; preferred buffers are MEA, and TEA. If present they are preferably used in the composition at levels of from 1 to 15 wt %.

The compositions may have their rheology modified by use of a material or materials that form a structuring network within the composition. Suitable structurants include hydrogenated castor oil, microfibrous cellulose and natural based structurants for example citrus pulp fibre. Citrus pulp fibre is particularly preferred especially if lipase enzyme is included in the composition.

The compositions may include visual cues of solid material that is not dissolved in the composition. Preferably they are used in combination with an external structurant to ensure that they remain in suspension.

The invention will now be further described with reference to the following non-limiting examples and to FIG. 1 which shows fragrance concentration profiles as measured by headspace sampling gas chromatography mass spectrometry. The log of the total integrated fragrance peak areas were plotted vs. time. T=25° C. Curves are: Osorb media with fragrance after the model wash solution of 60 minutes; SilaFresh media with fragrance after the model wash solution for 60 minutes, and a vial containing an equivalent amount of neat liquid fragrance to that entrapped in the media samples after rinsing.

Sol-Gel Materials

Two types of the sol-gel materials were assessed: Osorb® and SilaFresh™ media (Table 1). Osorb media is distinguished by a microporous morphology in the dry state whereas SilaFresh media possess a mesoporous structure. Neither product adsorbs water. The materials had been prepared using the methods described in Chem. Mater. 2008, 20, 1312-1321; and U.S. Pat. No. 8,367,793 B2. Both publications describe the synthesis. It is the processing conditions that determine whether the structure is micro- or meso-porous.

TABLE 1

Properties of Osorb ® and SilaFresh ™ Media

| Property | Osorb ® Media* | SilaFresh ™ Media* |
|---|---|---|
| Surface area, $m^2/g$ | 550 | 90 |
| Pore volume (dry), mL/g | 0.55 | 0.65 |
| Sebum capacity, mL/g media | 3 | 4.5 |
| Pore size type | microporous | mesoporous |

*INCI name: Dimethicone/Phenyl Silsesquioxane/Phenyl Bis-Sisesquioxane Crosspolymer

EXAMPLES

In the examples larger cut means media sieved to be in the range 25 to 78 microns and smaller cut means media sieved to be in the range 17 to 56 microns.

Example 1: Sensory Performance of Laundry Treatment Composition Containing SilaFresh Microparticles To demonstrate the sensory benefit of using the adsorbent microparticles in a laundry treatment composition, a machine wash test was conducted to compare the fragrance intensity of a control laundry treatment composition (Persil Small & Mighty, a 15 wash perfume containing laundry liquid sourced from the market) without microparticles added with the fragrance intensity of the control plus 0.6% w/w of unfragranced SilaFresh added to it. Both the control composition and the SilaFresh containing composition were left for 48 hours at ambient temperature on a bottle roller between introduction of the SilaFresh media and use in the washes. The SilaFresh was as received and did not have any perfume loaded into it before its addition to the already perfumed laundry liquid.

60 5×5 cm squares of knitted cotton, together with a woven polycotton ballast (total weight 1.5 kg), were placed in a Miele European front loading washing machine and 35 ml of either the control composition or the SilaFresh containing composition was added to the drum in the shuttle provided with the liquid. The wash was with water with a FH (degree French hardness) 12 at Ca:Mg ratio of 3:1 at 40° C. and lasted 1 hour and 20 minutes, and the final spin was 1400 rpm. Immediately after the final spin 20 of the 5×5 cm knitted cotton squares were placed in amber jars to represent performance out of the machine. The remaining 40 monitors were pegged on a line inside a room at ambient. After 1 hour, 20 of the line dried monitors were placed in amber jars, which represents the damp laundry stage. The remaining 20 monitors were left to dry for a further 23 hours and then placed in amber jars to represent the dry laundry stage. 10 trained sensory panelists rated the intensity of the monitors, within 1 hour of them being placed in the amber jar, using a 0 to 100 scale. Two replicates per treatment were assessed for each time point, and the statistics analysed using a Tukey HSD test via JMP software package. Table 2 gives the results.

TABLE 2

Sensory Performance of Persil Small & Mighty Containing SilaFresh

| Treatment | Time/hr. | Intensity |
|---|---|---|
| Persil control | 0 | 47.39 |
| no SilaFresh | 1 | 41.70* |
| | 24 | 4.13* |
| Persil + 0.6% w/w SilaFresh | 0 | 49.57 |
| | 1 | 58.48* |
| | 24 | 65.54* |

*Statistically significant at the 1, 24 hour time points.

The sensory results given in Table 2 show that the SilaFresh delivers a statistically significant fragrance benefit at the 1 hour and 24 hour assessment points.

Example 2: Sensory Performance of Laundry Treatment Compositions Containing Different Ratios of Osorb® Media at Various Perfume Levels To demonstrate the sensory benefit of employing the adsorbent media at different ratios of Osorb® to perfume, a machine wash test was conducted to compare the fragrance intensity of a laundry treatment liquid made in the laboratory (Table 3) without the media (at two levels of fragrance 0.4%, and 0.78% (composition in Table 4) compared to the same composition but with the addition of either 0.60% w/w of Osorb® with 0.78% fragrance or 1.2% w/w Osorb® with 0.4% w/w fragrance. Both the control composition and the Osorb® containing compositions were left for 48 hours at ambient temperature on a bottle roller prior to their subsequent use in the washes.

Then 60 5×5 cm squares of knitted cotton, together with a woven polycotton ballast (total weight 1.5 kg), were placed in a Miele European front loading washing machine and 35 ml of either the control composition or the Osorb® containing compositions were added to the drum in a shuttle provided with a market Persil Small & Mighty liquid. The wash was with FH 12 water with Ca:Mg ratio of 3:1 at 40° C. and lasted 1 hr. 20 mins and the final spin was 1400 rpm. Immediately after the final spin the 60 5×5 cm cotton monitors were pegged on a line at ambient temperature. After 30 minutes from the final spin 20 of the 5×5 cm monitors were placed in individual amber jars to represent performance at 30 minutes after the wash. The remaining 40 monitors were left pegged on a line at ambient, then after 4 hours from the final spin, 20 of the line dried monitors were placed in amber jars, which represents the just dry laundry stage. The remaining 20 monitors were left to dry over 24 hours from the final spin and then placed in amber jars to represent the dry laundry stage. 10 trained sensory panelists rated the intensity of the monitors, within 1 hour of them being placed in the amber jar, using a 0 to 100 scale. Two replicates per treatment were assessed for each time point, and the statistics analysed using a Tukey HSD test via JMP software package. Table 5 gives the results.

TABLE 3

Laundry Treatment Compositions used for Example 2

| Material | Control 2B | Control 2A | 2.1 | 2.2 |
|---|---|---|---|---|
| LAS Acid | 5.82% | 5.82% | 5.82% | 5.82% |
| Neodol 25-7[a] | 4.37% | 4.37% | 4.37% | 4.37% |
| TEA | 8.82% | 8.82% | 8.82% | 8.82% |
| SLES 3-EO | 6.24% | 6.24% | 6.24% | 6.24% |
| Citric Acid | 2.0% | 2.0% | 2.0% | 2.0% |
| Fatty Acid Palmera B123 | 0.86% | 0.86% | 0.86% | 0.86% |
| Dequest 2010 | 2.5% | 2.5% | 2.5% | 2.5% |
| Sokalan HP-20[b] | 3.88% | 3.88% | 3.88% | 3.88% |
| Texcare SRN UL 50[c] | 2.0% | 2.0% | 2.0% | 2.0% |
| Osorb ®[d] | 0.0% | 0.0% | 0.6% | 1.2% |
| Fragrance[e] | 0.78% | 0.40% | 0.78% | 0.40% |
| Demineralized Water | To 100% | To 100% | To 100% | To 100% |

[a]Ex Shell;
[b]Ex. BASF;
[c]Ex. Clariant;
[d]Ex. ABS < 400 mesh particle size;
[e]Ex. IFF (composition in Table 4).

TABLE 4

Composition of Laundry Fragrance Ex. IFF

| Material | % W/W. | $\log K_{ow}$ |
|---|---|---|
| Manzanate | 6.64 | 2.4 |
| Limonene | 8.86 | 3.4 |
| Dihydromyrcenol | 8.71 | 2.9 |
| Benzyl acetate | 4.39 | 2.0 |
| Geraniol | 2.09 | 2.9 |
| Dimethyl benzyl carbinyl acetate | 8.88 | 2.7 |

TABLE 4-continued

| Composition of Laundry Fragrance Ex. IFF | | |
|---|---|---|
| Material | % W/W. | $\log K_{ow}$ |
| C12 Aldehyde MNA | 10.19 | 4.9 |
| Verdyl acetate | 8.89 | 2.2 |
| β-Ionone | 8.74 | 2.9 |
| Lilial | 8.34 | 3.6 |
| n-Hexyl salicylate | 4.60 | 5.7 |
| Tonalid | 8.93 | 4.8 |
| Phenafleur | 10.74 | 3.8 |

logKow values are taken from the Good Scents website.

TABLE 5

| Sensory Performance of Liquid Composition (Table 3) With or Without Osorb ® | | |
|---|---|---|
| Treatment | Time/hr. | Intensity (0-100) |
| Control 2A no Osorb ® with 0.4% w/w Laundry Fragrance | 0.5 | 34.25[(2)] |
| | 4 | 5.96 |
| | 24 | 2.81 |
| Control 2B no Osorb ® 0.78 % w/w Laundry Fragrance | 0.5 | 51.22[(1)] |
| | 4 | 8.36 |
| | 24 | 4.13 |
| Sample 2.1 0.6% Osorb ® 0.78% w/w Laundry Fragrance | 0.5 | 26.52 |
| | 4 | 15.52[(3)] |
| | 24 | 11.25[(3)] |
| Sample 2.2 1.2% Osorb ® 0.40% w/w Laundry Fragrance | 0.5 | 21.56 |
| | 4 | 27.68[(4)] |
| | 24 | 21.37[(4)] |

[(1)]Statistically significant at 95% CI over all other samples at 30 minutes;
[(2)]Statistically significant at 95% CI over 1.2% Osorb ® at 30 minutes, but not the other samples at 30 minutes;
[(3)]Statistically significant at 95% CI over both control samples at 4 hours, and 24 hours;
[(4)]Statistically significant at 95% CI over all samples at 4 hours, and 24 hours.

The results show that both levels of perfume loading provide significant performance benefits after 30 minutes drying time. Surprisingly, the 49% perfume reduction at an Osorb® level of 1.2% provides a remarkable performance benefit over all other samples including sample 2.1.

The invention claimed is:

1. A composition comprising:

i) at least 5 wt % amphiphilic material, ii) from 0.1 to 5 wt % perfume, iii) 0.2 to 6 wt % of porous microparticles comprising sol-gel derived material, the sol-gel derived material including a plurality of alkylsiloxy substituents and wherein the sol-gel derived material is obtained from:

(a) at least one first alkoxysilane precursor having the formula:

$$(R'O)_3—Si—(CH_2)_n—Ar—(CH_2)_m—Si—(OR')_3 \quad (1)$$

where n and m are individually an integer from 1 to 8, Ar is a single-, fused-, or poly-aromatic ring, and each R' is independently a $C_1$ to $C_5$ alkyl group and (b) optionally, at least one second precursor having the formula:

$$_x(R'O)—\underset{}{\overset{(R)_y}{\overset{|}{Si}}}—\left(\underset{}{(R'')}—\overset{(R)_y}{\overset{|}{Si}}—(OR')_x\right)_z \quad (2)$$

where x is 1, 2, 3 or 4; y is 0, 1, 2, 3; z is 0, 1; the total of x+y+z is 4; each R is independently an organic functional group; each an R' is independently a $C_1$ to $C_5$ alkyl group and R" is an organic bridging group, where the sol-gel derived material is swellable to at least 2.5 times its dry mass, when placed in excess acetone, whereby the weight amount of iii) exceeds the weight amount of ii) in the composition; and wherein the composition is an aqueous liquid, comprising at least 30 wt % water.

2. The composition according to claim 1 wherein the plurality of alkylsiloxy groups have the formula:

$$—(O)_w—Si—(R_3)_{4-w} \quad (3)$$

where each $R_3$ is independently an organic functional group and w is an integer from 1 to 3.

3. The composition according to claim 1 wherein at least 70 wt % of the perfume has a log $K_{ow}$ of greater than 2.8.

4. The composition according to claim 1 wherein the first alkoxysilane precursors of formula (1) are selected from the group consisting of bis(trimethoxysilylethyl)benzene, 1,4-bis(trimethoxysilylmethyl)benzene and mixtures thereof.

5. The composition according to claim 1 wherein the microparticles have a volume average diameter of 2 to 100 microns.

6. The composition according to claim 5 wherein the microparticles have a volume average diameter of 10 to 80 microns.

7. The laundry composition according to claim 1 wherein the microparticles have a microporous structure.

8. The laundry composition according to claim 1 wherein the amphiphilic material comprises detersive surfactant.

9. The laundry composition according to claim 8 wherein the detersive surfactant comprises at least 5 wt % anionic surfactant.

10. The laundry composition according to claim 9 wherein the detersive surfactant further comprises at least 2 wt % nonionic surfactant.

11. A method of prolongation of perfume delivery from a liquid laundry treatment composition comprising perfume according to claim 1, the method comprising the steps of:

(i) adding sol-gel derived silica microparticles according to any preceding claim to the liquid composition;

(ii) optionally, diluting the liquid and applying the liquid or the diluted liquid to a surface to be treated to deposit the microparticles onto the surface;

(iii) rinsing away the liquid or diluted liquid to leave perfume loaded microparticles on the surface to be treated; and (iv) releasing perfume from the microparticles over period of about 24 hours.

12. The composition according to claim 1 wherein the composition is a laundry treatment composition.

13. The composition according to claim 1 wherein the at least 15 wt % perfume has a log $K_{ow}$ greater than 4.

* * * * *